US005904640A

United States Patent [19]

Shahinian

[11] Patent Number: 5,904,640

[45] Date of Patent: May 18, 1999

[54] EXTENDED CENTRIPETAL ROTATOR EXERCISE DEVICE

[76] Inventor: Araz R. Shahinian, 11 Wintermute La., Lebanon, N.J. 08833

[21] Appl. No.: 08/799,867

[22] Filed: Feb. 14, 1997

[51] Int. Cl.[6] ..... A63B 21/22

[52] U.S. Cl. ..... 482/110; 482/93

[58] Field of Search ..... 482/82, 92, 93, 482/106, 108, 110, 139, 148

[56] References Cited

U.S. PATENT DOCUMENTS

| | | | |
|---|---|---|---|
| 460,270 | 9/1891 | Somerey | 482/110 X |
| 4,177,985 | 12/1979 | Hlasnicek et al. | 482/110 X |
| 4,505,474 | 3/1985 | Mattox | 482/82 |
| 4,557,479 | 12/1985 | Guibert | 482/139 X |
| 4,618,142 | 10/1986 | Joseph, Jr. . | |
| 4,787,624 | 11/1988 | Grant . | |
| 5,054,772 | 10/1991 | Winston | 482/82 |
| 5,441,471 | 8/1995 | Passer . | |
| 5,478,297 | 12/1995 | Dennis, Jr. . | |

*Primary Examiner*—John Mulcahy
*Attorney, Agent, or Firm*—Kenneth P. Glynn, Esq.

[57] ABSTRACT

An extended centripetal rotator device includes an elongated tubular member. In one embodiment the tubular member includes an inner member extending through the inside of the tubular member and having its ends extending out of each end of the tubular member and being rotatable relative to one another. In another embodiment two rotatable members are included at opposite ends. The inner member, tubular member and rotatable members may be flexible, semi-flexible or rigid. The ends of the inner member and the ends of the tubular member and rotatable members may also be configured to receive weight members and spring members that are capable of minimizing shoulder strain to a user. Preferably, the present invention is grasped at opposite ends of the tubular member and held at chest height. The present invention is then oscillated toward and away from the user in a reciprocating motion wherein the ends of the inner member move circularly relative to the tubular member.

6 Claims, 3 Drawing Sheets

EXTENDED CENTRIPETAL ROTATOR EXERCISE DEVICE

BACKGROUND OF THE INVENTION

1. Field of the Invention

The present invention is directed to a bar-type exercise device for simultaneously building endurance and upper body muscular strength. More specifically, the present invention is directed to a device having an elongated tubular member. A first version has an inner member rotatably disposed in the tubular member with the ends of the inner member extending beyond the tubular member ends. A second version has two independent members rotatably attached to and extending beyond each tubular member end.

2. Description of the Prior Art

Jump ropes have been used for years as means of increasing a person's endurance. Weight training is a long standing means of increasing muscle strength. It is known that using weights during jumping rope, running, or other aerobic exercise combines the benefits of both.

In particular, combining weights with jumping rope increases endurance while increasing the muscle strength in the arms and chest. There have been various exercise devices which have attempted to do just that such as weights which can be attached to jump rope handles, hollow jump rope handles into which liquid or granular material could be added or withdrawn to increase or decrease weight, weighted gloves for use during jump roping, and even rope for use in jumping rope which had a high density core to add extra weight. These devices typically had drawbacks such as being cumbersome, lacking durability, interfering with the exercise motion, and not allowing for easy weight adjustment.

U.S. Pat. No. 4,787,624 disclosed a jump rope attachment which connected to various weight standard hand weights. The device was used like a conventional jump rope. The idea was to allow relatively quick changing between weights.

U.S. Pat. No. 5,478,297 disclosed a high speed jump rope using handles consisting of a non-rotating tubular grip and a rotary spindle rod to which the rope was attached so as to minimize rope twisting and wear.

Bar-type jump rope exercise devices are better suited for using adjustable amounts of weight than are jump rope type devices with unconnected weighted handles or weighted ropes. A typical bar-type exercise device for jumping rope has a horizontal bar having one end of a jump rope attached to each end of the bar. To the ends of some of these exercise devices have been added weights and some have a pair of hand grips rotatable with respect to the horizontal bar to allow the weights and bar to rotate freely during use. A problem with these exercise devices is that when weight is added to the ends of a bar-type device, the device is difficult to use because there is no corresponding increase in the mass of the jump rope. The jump rope accelerates quickly while the bar and weights do not, causing the line to wrap around the bar.

U.S. Pat. No. 4,618,142 taught the use of a bar-type jump rope exercise device having a pair of positionable hand grips and a two parallel stand-off rods at right angle to the bar. The ends of the jump rope were attached to the ends of the stand-offs to increase the effective weight of the jump rope. That same patent also taught offsetting the center axis of the weights relative to the bar so as to rotate not only the rope about the bar, but also the weights. The radial position of the standoffs and the rope relative to the weights, could also be changed for additional challenge in coordinating the weights and the standoffs with rope during exercise.

Among the above, all of the jump rope exercise device patents show devices with or without a bar, which use one continuous loop of jump rope with each rope end attached to a handle, bar, or standoff, the opposite of the present invention.

Notwithstanding the above-cited prior art, the present invention is neither taught nor rendered obvious thereby.

SUMMARY OF THE INVENTION

The present invention is an extended centripetal rotator exercise device for improving both a person's endurance and upper body strength. The device has two versions. Both versions have an elongated tubular member (tube). A first version includes an inner member extending through the inside of the tube with each end of the inner member extending out of an end of the tube such that both ends rotate together. A second version has two unattached rotatable members, one rotatably attached to and extending from each end of the tube. The inner member and rotatable members can be flexible, semi-rigid, rigid, or somewhere in between. The ends of the inner member and rotatable members can be configured to receive spring members, which decrease shoulder joint strain to the user, and/or weight receiving members. The device is grasped at each end of the tube with the device about chest or shoulder height. The tube is moved toward and away from the user in a reciprocating motion such that the ends or end members move circularly relative to the tube.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
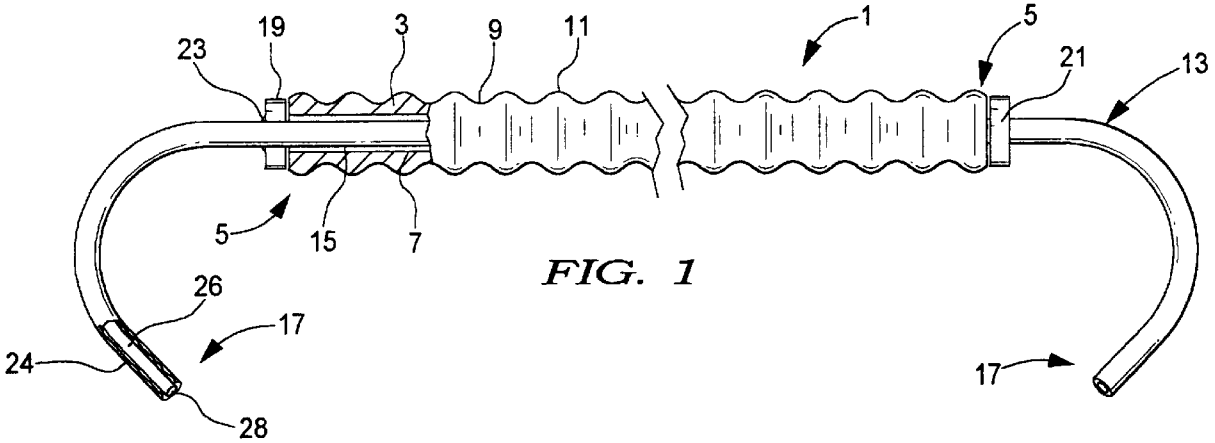
FIG. 1 shows a partially broken side view of an embodiment of the device which utilizes an inner member of flexible rope or cord.

The present invention, an extended centripetal rotator exercise device, is a bar-type exercise device having an elongated tubular member which is substantially rigid (minimal flexing under load) such as steel, semi-rigid (elastically deforms under load) such as plastic such as polyvinyl chloride or composites, or somewhere in between. The tubular member should, preferably, be light weight to cause less fatigue and provide a more balanced workout for the muscle groups of the user's upper body and chest.

There are two basic versions of the present invention device. A first version has an inner member of longer length than the tubular member disposed in the tubular member with the ends of the inner member extending from both ends of the tubular member. The inner member can be rigid, such as steel; semi-rigid such as plastics, composites, or tubular plastic with granular material, liquid material, plastics and/or foam within the tube; flexible (such as rope or cord), or somewhere in between with the preferred version being semi-rigid. A semi-rigid or flexible inner member can be made from a flexible cord core over which a coating of flexible or semi-rigid plastic or foam plastic may be applied. The thickness of the cord, the outer coating, and in the case of foam plastic, the ratio of the number of open cells versus closed cells in the outer coating, all can be varied to adjust the flexibility of this inner member. The inner member rotates relative to the tubular member and there may be bushings, ball bearings, or other such friction reducing components between the tubular member and inner member, particularly adjacent the tubular member ends.

The second version of the exercise device has two unconnected rotatable members, with one rotatably attached to and extending from each tubular member end. Each rotatable member can rotate freely of the other or may be connected via additional elements, such as rods or tubes, but are preferably not connected to one another in this version. The rotatable members may be permanently attached, such as by capping, force fitting, gluing or removably attaching to the tubular member such as by threads. For example, the ends of the tubular member may be capped or crimped onto expanded ends of the rotatable members or to bushings, bearings, washers or other friction reducing components to which the rotatable members may be attached.

Both versions of the present invention device differ from any previous jump rope or bar-type devices because on this device the outer ends of the inner member, the jump rope of prior devices, are not connected.

Both versions of the device have each inner member end or the rotatable member adapted to receive an attachment component, e.g. permanent end or a plurality of sets of removable ends, including springs and/or weight receiving rods. Where springs and/or weight receing rods are used the tubular member (and inner member) has a longitudinal axis, and the springs and rods likewise have longitudinal axes. Each axis of the spring and/or rod is angled away from the longitudinal axis of the tubular member so as to offset the spring and/or rod relative to the tubular member. The axes of the springs and/or rods are typically symmetrical, though they could be made non-symmetrical either by permanent or adjustable means.

The preferences of various versions of the device are as follows from most to least preferable: 1) semi-rigid end or rotatable members, 2) spring end or rotatable members without added weights, 3) end or rotatable members with spring mounted weights, and 4) end or rotatable members with weights alone. The preferences are based on the muscular workout obtained in a given time period versus the stresses affecting the user's joints.

The device is used by grasping the tubular member with both hands and holding the device approximately parallel to the ground at about chest or shoulder height. The device is preferably moved toward and away from the user in a reciprocating motion so as to cause the ends or rotatable members to rotate circularly relative to the tubular member and in an elliptical path as viewed from the side. The present invention device can also be used moving in a vertical motion or somewhere in between horizontal and vertical. The present invention device can also be used with the tubular member moving in a circular, elliptical, or somewhere in between path. The device can even be used without keeping the tubular member parallel to the floor with each end of the tubular member moving in a reciprocal motion opposite that of the other such as is done when paddling a kayak.

During use of the device, the tubular member bows, particularly at the smallest radius portions of the elliptical path the ends take, the ends typically move in due to the higher centrifugal forces in those portions. This bowing can cause higher stresses to be applied to the user's shoulder joints and decrease the muscular workout. The use of the springs either as the ends or rotatable members, or using springs to mount the weight receiving rods, weights, and collars lessens the maximum stresses applied to the user. This is because when a tight radius portion of the ellipse is reached the spring absorbs some of the energy due to the increased centrifugal force which would otherwise be transferred through the tubular body to the user and then smoothly releases the stored energy. The preferred spring is angled at about 55 degrees off the longitudinal axis of the tubular member and can bend to a maximum angle of about 90 degrees during use. The spring will not bend significantly in the reverse direction.

During use the device provides a combination of isotonic (lifting the exercise device against gravity), isokinetic (the more force input by the user the more the exercise device resists), and isometric (none or only limited movement using the exercise device) benefits.

The resistance of the device and thus the type and extent of workout received by the user can be varied by a) elongating the ends of the inner member or end members, b) adding friction between the inner member or end members and the tubular member (such as by using a drag clutch), c) using heavier or denser ends of the inner member or end members, d) adding additional weights to the ends of the inner member or end members, and e) using a spring inner member end or end member and/or decreasing the tension of the existing spring.

Referring to FIG. 1, the exercise device 1 in the simplest form comprises an elongated tubular member 3 which has two end portions 5, an inner surface 7 and an outer surface 9. Outer surface 9 may have ridges 11 to aid in a person's hand gripping the tubular member 3. An elongated flexible inner member 13 is disposed within the tubular member 3 and has an outer surface 15, which contacts the inner surface 7 of tubular member 3 with inner surface 7 acting as a bearing for inner member 13 during relative motion of inner member 13 and tubular member 3. The two ends 17 of inner member 13 extend beyond the ends of the tubular member 3. A pair of circular stops 19 having a circular aperture 21 are disposed about the inner member 13 adjacent each end portion 5 of tubular member 3. The stops 19 are affixed to the inner member 13 as by glue fillet 23 adjacent the perimeter of apertures 21. Inner member 13 may be solid or may be tubular in construction such as with a solid plastic or foam outer jacket 24 and inner core 26 being loose sand, polyurethane and/or other composition desired to obtain the desired weight and flexure. The ends 17 of inner member 13 may be sealed by conventional means such as hot sealing or gluing 28.

Figure 2:
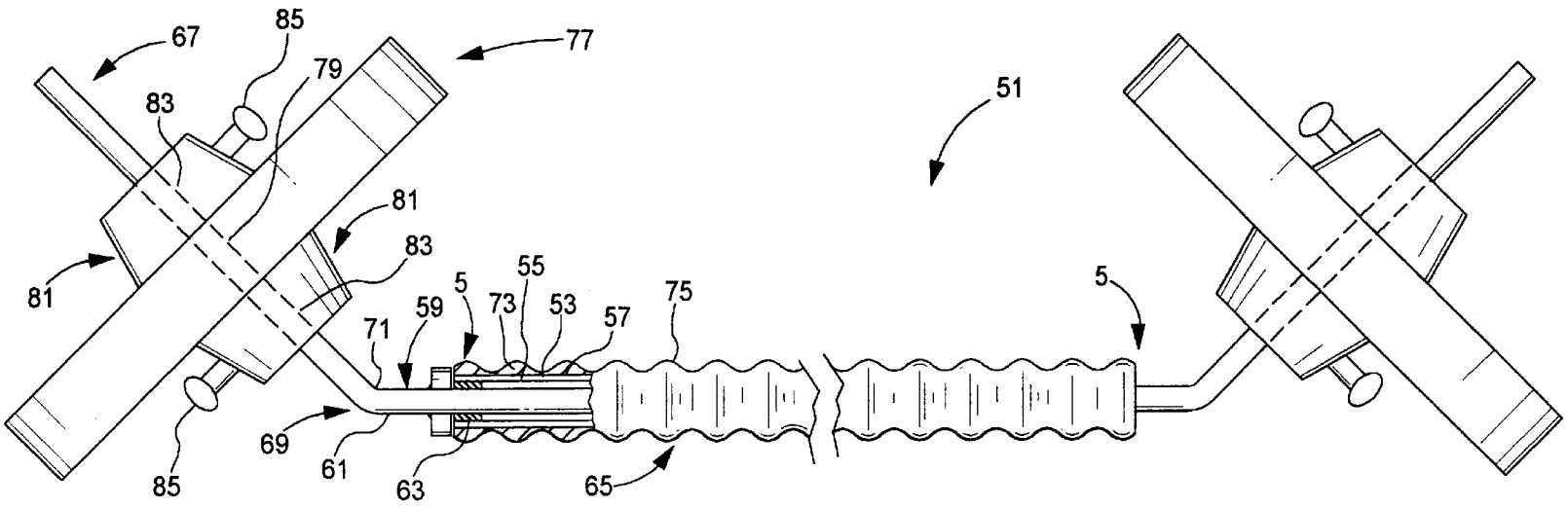
FIG. 2 is a partially broken side view of an embodiment using a rigid metal inner member having two angled weight receiving ends.

FIG. 2 shows an exercise device 51 having an elongated tubular member 53, which has an inner surface 55 and a non-textured outer surface 57. A rigid elongated inner member 59 having an outer surface 61 is disposed within the tubular member 53. A bearing 63 may be disposed between outer surface 61 and inner surface 55 at each end 5 of tubular member 53. Inner member 59 has a middle portion 65 and two weight receiving end portions 67 which extend beyond the ends 5 of tubular member 53 through coplanar angle portions 69 of inner member 59. The inner portions 71 of angle portions 69 act as stops which contact the ends 5 of tubular member 53 or bearings 63 upon longitudinal shifting of the inner member 59 relative to handle 53 during use of the exercise device. A gripping member 73 having ridges 75 is disposed about the exterior surface 57 of tubular member 53 to aid in gripping by the user's hands. Standard weights 77 having apertures 79 and standard collars 81 having apertures 83 slidably engage weight receiving end portions 67 and are locked thereto by tightening standard wing bolts 85.

Figure 3:
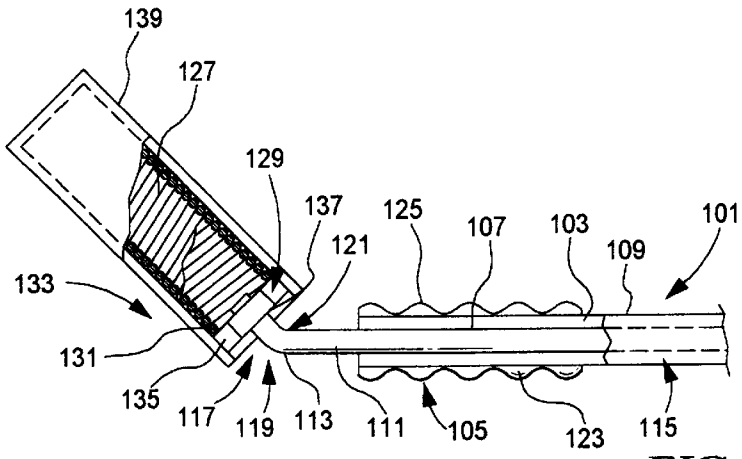
FIG. 3 is a side view of an embodiment similar to FIG. 2 with removable springs and attached pads.

FIG. 3 shows an exercise device 101 having an elongated tubular member 103, made of metal, plastic such as polyvinyl chloride, or the like, the tubular member 103 having two ends 105, an inner surface 107, and a non-textured outer surface 109. A rigid elongated inner member 111 is disposed within the tubular member 103 and inner member 111 has an outer surface 113, which contacts the inner surface 107 of tubular member 103 with outer surface 113 acting as a bearing for inner member 111 during motion of inner member 111 relative to tubular member 103. Inner member 111 has a middle portion 115 and two threaded end portions 117 which extend beyond the ends 105 of tubular member 103 by way of coplanar angle portions 119. The inner portions 121 of angle portions 119 function as stops which contact the ends 105 of tubular member 103 upon longitudinal shifting of the inner member 111 relative to tubular member 103 during operation of the device. A pair of gripping members 123 having ridges 125 are disposed about the outer surface 109 of tubular member 103 at each end of tubular member 103 to aid in gripping by the user's hands. A coil spring 127 is removably affixed to the threaded end portion 117 (though it could be permanently affixed thereto) by using threaded hex nuts 129, one of which is brazed or welded as at 131 to a first end 133 of each spring 127. Hex nut 129 then threadably engages the mating threads of threaded end portion 117 and is torqued down by using a standard wrench on hexagonal faces 135 until hex nut 129 bottoms against shoulder 137 on end portion 117. The springs 127 can be removed and replaced by another attachment (as in FIG. 4) by reversing the procedure. A pad 139 is disposed about spring 127 and held in place by conventional means such as friction, gluing, or by encompassing spring 127 on all sides. The purpose of pad 139 is to prevent or reduce injury to the user or a bystander during operation of the device. Pad 139 may be made of any conventional material and can be made to be removable for washing or replacement.

Figure 4:
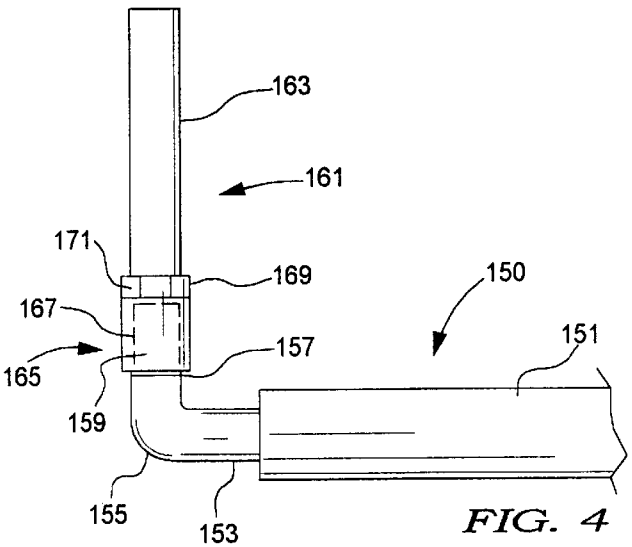
FIG. 4 is a side view of a removable weight receiving rod for use with standard plate-type weights and collars.

FIG. 4 shows a present invention exercise device 150 having a tubular member 151 and an inner member 153 having a 90 degree angle bend 155, a shoulder 157, and terminating in a threaded end portion 159. A weight receiving rod 161 has an upper portion 163 sized to accept standard plate type weights and collars. Rod 161 also has a lower portion 165 comprising a female threaded portion 167, which is sized to threadably engage end portion 159, and rod 161 further having a hex nut 169 having hex faces 171 to engage a standard wrench for tightening rod 161 against shoulder 157 of rod 161.

Figure 5:
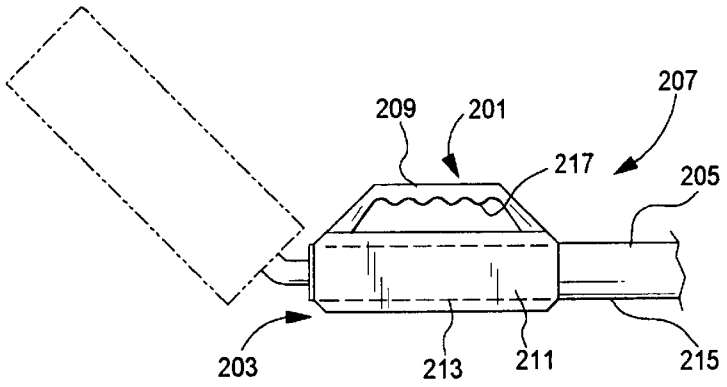
FIG. 5 is a side view of the device with separate or integrally molded gripping handles.

FIG. 5 shows a handle 201 which is positioned on each end 203 of tubular member 205 to aid in gripping of exercise device 207. Each handle has a gripping portion 209 and a tubular body portion 211 having an inner surface 213 juxtaposed outer surface 215 of tubular member 205. The handles 201 can be positioned anywhere along tubular member 205 as desired, but would typically be positioned proximate the tubular member ends 203. The inner surface 213 can be fastened to outer surface 215 of tubular member 205 by means such as gluing or can be molded integrally with tubular member 205 such as by injection molding handles 201 with tubular member 205. The handles 201 are used during exercise by holding the gripping portion 209, which may be flat or may have ridges 217 to aid in gripping handle 201. The exercise device is used with handles 201 as in the other embodiments of the invention.

Figure 6:
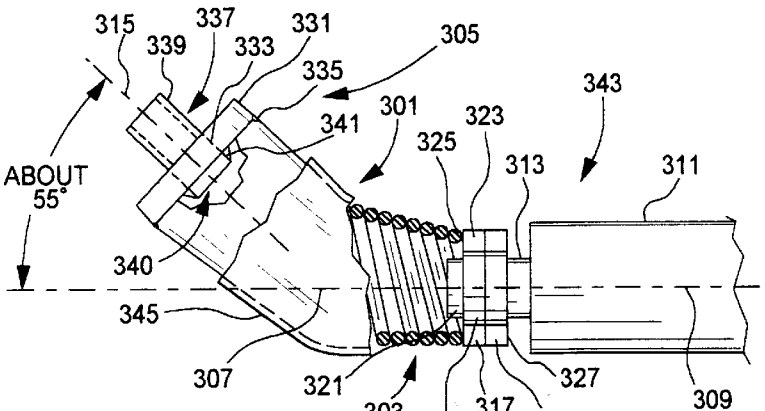
FIG. 6 is a partially broken side view of a preferred embodiment bent conical type removable spring.

FIG. 6 shows a preferred embodiment spring 301 which has a first end 303 and a second end 305. Spring 301 also has a first axis 307 which is the same as the longitudinal axis 309 of tubular member 311 and inner member central portion 313. Spring 301 also has a second axis 315 which is at an angle of approximately 55 degrees with axes 307 and 309. A hex nut 317 has threaded aperture 319 which is sized to threadably engage threaded end portion 321 of inner member 313 and hex faces 323. Nut 317 is affixed to spring end 303 as by braze or weld bead 325. Spring 305 is threadably attached to threaded end portion 321 and oriented such that both springs 305 are in the same plane, then that orientation is held by tightening hex jam nut 327 against hex nut 317 by engaging two standard wrenches with hex faces 323 and 329. An end plate 331 having an aperture 333 is affixed to spring end 305 as by braze or weld bead 335. A stud 337 having threads 339 may be used to mate with the spring and weight receiving rods such as are shown in FIGS. 3 and 4. Stud 337 has a non-threaded lower portion 340 which is slightly smaller than and inserted into aperture 333. Stud 337 is affixed to plate 331 as by brazing or welding 341. Either of the spring or rods can be used with this exercise device 343 by threadably engaging either with the threaded portion 339 of studs 337 and tightening using a standard wrench on the hex faces until the spring or rod bottom out on the end plate 331. Spring 305 is designed such that during use of exercise device 343 with spring 305, spring 305 can bend such that axis 315 can move to a maximum angle of about 90 degrees with respect to axes 309 and 307 due to centrifugal force, but cannot become less than about 55 degrees at any time during device use. This feature serves to redistribute the stress to the user's body and in particular relieve stress from a person's shoulder joints. A pad 345 can partially or completely cover spring 305, end plate 331, hex nut 317, and hex nut 327. The pad can be secured to itself such by using hook and loops like "VELCRO".

Figure 7:
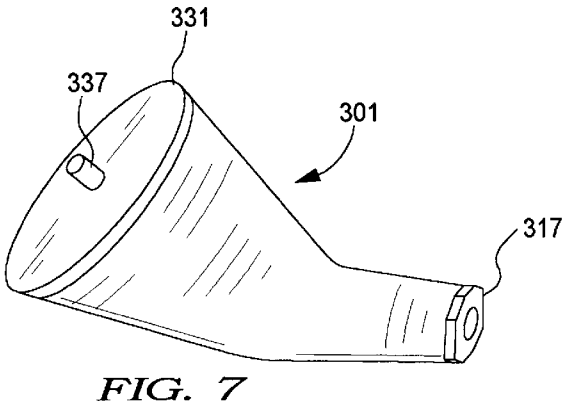
FIG. 7 is a perspective view of a preferred spring of FIG. 6.

FIG. 7 shows preferred embodiment spring 301 from FIG. 6 showing the curved conical shape of the spring. Hex nut 317, end plate 331, and threaded stud 337 are all attached as shown in FIG. 6.

Figure 8:
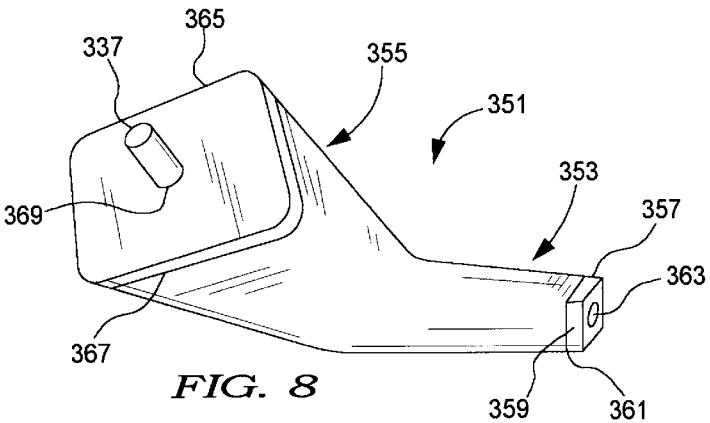
FIG. 8 is a perspective view of another bent conical type preferred spring having essentially straight sides.

FIG. 8 shows another preferred embodiment spring 351 having a lower portion 353 and an upper portion 355. A square nut 357 having faces 359 is brazed or welded as at 361 to spring lower portion 353. The threads 363 mate with the threaded end portions of the inner member of FIG. 6. An end plate 365 is brazed or welded as at 367 to end 355 of spring 351. End plate 365 has an aperture 369 into which stud 337 is inserted and attached as in FIG. 6. Spring 355 is more angular in shape than the other preferred embodiment spring shown in FIGS. 6 and 7.

Figure 9:
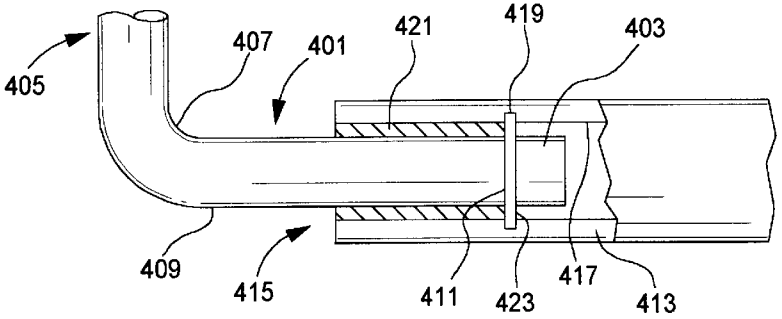
FIG. 9 is a partially broken side view of an embodiment having two independently rotatable members with bushings and retaining rings.

FIG. 9 is an embodiment having two separate rotatable members 401 each of which can rotate freely of the other.

Each end member 401 has an inner end 403, an outer end 405 which can be made to accommodate permanently attached or removable attachments as described previously, an angled portion 407, an outer surface 409, and inner end 403 has a circumferential groove 411. Tubular member 413 has ends 415, an inner surface 417, and circumferential groove 419. A bushing 421 is rotatably disposed about inner member outer surface 409 and press fit, glued, or otherwise retained temporarily or permanently against inner wall 417. A retaining ring 423 is disposed in grooves 411 and 419 to retain end member 401 inner end 403 within tubular member 413. Groove 411 is deep enough to accommodate retaining ring 423 prior to seating in groove 419 during assembly of inner end 403, bushing 421, and retaining ring 423 into tubular member 413.

Figure 10:
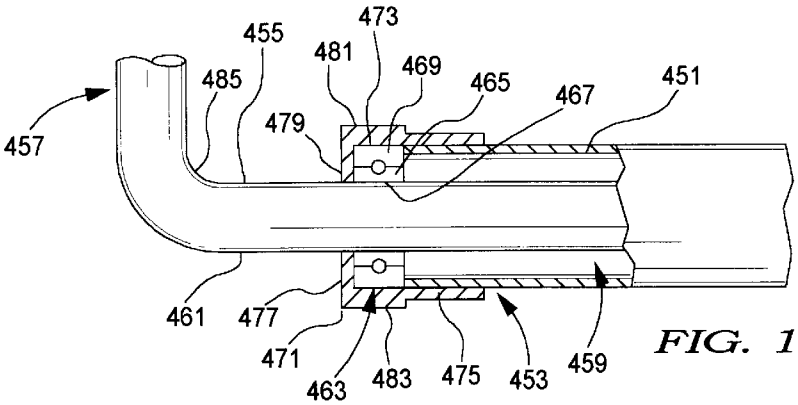
FIG. 10 is a partially broken side view of an embodiment having ball bearing end caps.

FIG. 10 shows tubular member 451 having a threaded end portion 453. An inner member 455 having outer ends 457, center portion 459, and outer surface 461, is disposed with center portion 459 within tubular member 451. Ball bearings 463 each having inner races 465, inner apertures 467, and outer races 469, are disposed one adjacent each tubular member end portion 453 with inner member center portion 459 frictionally disposed within each inner race aperture 467 such that the inner race 465 rotates with inner member 455. A pair of cup shaped end caps 471 each have a flat inner surface 473, a threaded inner surface 475 which mates with threaded end portion 453, and a bottom 477. Bottom 477 has an aperture 479 which is coaxial with the bearing inner race 465, center portion 459, and inner race aperture 467. Inner member center portion 459 is disposed coaxially through end cap aperture 479. End cap threaded surface 475 threadably engages tubular member threaded end 453 with bearing 463 nesting inside each end cap 471 adjacent bottom 477 and flat inner surface 473. End caps 471 have a hex nut portion 481 having flats 483 to engage a standard wrench for tightening end caps 471 on tubular member threaded end portions 453. Bearing outer race 469 is kept from rotating relative to end cap 471 and inner member 451 by being sandwiched between end cap bottom 477 and tubular member end portion 453. Inner member 455 has an 90 degree angle portion 485 located between inner portion 459 and outer ends 457. Angle portion 485 contacts end cap bottom 477 acting like a stop upon longitudinal shifting of inner member 455 relative to tubular member 451 and end cap 471. The ball bearings 463 make this embodiment especially adapted to exercise using plate style weights and collars as shown in FIG. 2 to maximize the life of the exercise device.

Obviously, numerous modifications and variations of the present invention are possible in light of the above teachings. It is therefore understood that within the scope of the appended claims, the invention may be practiced otherwise than as specifically described herein.

What is claimed is:

1. An extended centripetal rotator exercise device comprising:

a) an elongated tubular member having two opposite end portions and a longitudinal axis, said tubular member being provided with means for aiding a person in gripping the tubular member;

b) an elongated semi-flexible inner member of longer length than the tubular member, the inner member having a longitudinal axis and two end portions, the inner member including a hollow center containing a weighted inner core filler, the inner member positioned within and extending completely through the tubular member, the inner member having an end portion exiting at and extending beyond each end portion of the tubular member; and c) stop means to prevent the inner member from being longitudinally removed from the tubular member, said stop means being fixedly located about the inner member inward from the end portions thereof and adjacent said opposite ends of said tubular member.

2. An extended centripetal rotator exercise device as in claim 1, wherein the inner member is a semi-flexible hollow line.

3. An extended centripetal rotator exercise device as in claim 2, wherein the inner member line is a hollow semi-flexible line containing a weighted inner core filler.

4. An extended centripetal rotator exercise device as in claim 3, wherein the inner core filler is a filler selected from the group consisting of loose sand, polyurethane and mixtures thereof.

5. An extended centripetal rotator exercise device as in claim 3, wherein the tubular member has an outer surface and which outer surface has circumferential ridges and depressions to aid a person in gripping the tubular member.

6. An extended centripetal rotator exercise device as in claim 3, wherein the tubular member has an outer surface about which is disposed an outer grip having circumferential ridges and depressions to aid a person in gripping the tubular member.

* * * * *